United States Patent [19]

Schuetz

[11] 4,037,449

[45] July 26, 1977

[54] CONTINUOUS FLOW PLUG MILL SYSTEM

[75] Inventor: James W. Schuetz, Pittsburgh, Pa.

[73] Assignee: Aetna-Standard Engineering Company, Ellwood City, Pa.

[21] Appl. No.: 710,013

[22] Filed: July 30, 1976

[51] Int. Cl.[2] ..... B21B 17/10

[52] U.S. Cl. ..... 72/209; 72/234

[58] Field of Search ..... 72/209, 208, 214, 220, 72/97, 234

[56] References Cited

U.S. PATENT DOCUMENTS

| | | | |
|---|---|---|---|
| 1,986,833 | 1/1935 | Littler | 29/33.4 |
| 2,528,651 | 11/1950 | Gross | 72/97 |
| 3,277,687 | 10/1966 | Kelly | 72/209 |

*Primary Examiner*—Milton S. Mehr

*Attorney, Agent, or Firm*—Mandeville and Schweitzer

[57] ABSTRACT

The disclosure relates to method and apparatus for the operation of a plug mill, in the production of seamless tubes. Provisions are made for maintaining a circulating supply of plug and mandrel assemblies such that, after a tubular shell from a piercing mill has been given a first pass through the plug mill, the entire combination of the plug and mandrel assembly, and the just-processed shell, are transferred bodily into alignment with the axis of a second stage mill. The shell is then advanced in the same direction through a second mill stand, over a second plug, while simultaneously being stripped from the first mandrel. By enabling the shell to be passed through the second plug mill pass, without the requirement of an intermediate operation of stripping the shell from the first stage mandrel, significant time economies are realized. With conventional plug mill equipment and techniques, the plug mill represents a bottleneck in the sequence of operations involved in the production of seamless tubing. In contrast, with the method and apparatus of the invention, the plug mill can easily operate at a greater rate of speed than the piercing mill supplying tubular shells to it. This is accomplished with only a modest increase in investment in mill equipment.

19 Claims, 5 Drawing Figures

CONTINUOUS FLOW PLUG MILL SYSTEM

BACKGROUND AND SUMMARY OF THE INVENTION

In the production of seamless tubing, metal blanks are initially passed through one or more stages of piercing mills, in which an initially solid workpiece is driven spirally over a piercing point, to form a hollow tubular shell. After the workpiece has passed through the piercing mill, the mandrel, which supports the piercing point during the piercing operations, is withdrawn from the processed shell, and the shell is subsequently processed in the plug mill. In a conventional plug mill system, the tubullar shell is driven through the mill stand, over a cylindrical plug, reducing the side wall thickness thereof and increasing tube length. Conventionally, two passes through the plug mill are required, with the tubular shell being rotated 90° from its original orientation in preparation for the second pass through the mill.

In a conventional plug mill, the mandrel plug is supported on the end of an elongated mandrel bar, which is in compression during the rolling operation. As soon as the tubular shell passes completely through the mill rolls, and its trailing end is beyond the mandrel plug, the plug is removed. The mill rolls are then opened slightly, and the shell is gripped on the downstream side of the mill rolls by reversely rotating stripper rolls, which return the shell back to the upstream side of the primary mill rolls. When the shell is back on the upstream side of the mill, new mandrel plug is brought into position (and mill rolls closed) and the shell, now rotated 90° from its original orientation, is sent back through the mill for its second pass. At the end of the second pass, the same return sequence is repeated, with the just-used plug being removed, the primary mill rolls opening slightly, and the stripper rolls driving the processed tubular shell back to the upstream side of the mill rolls. After its second pass, through the plug mill, the tubular shell is removed for further processing, such as in a reeling mill.

As will be appreciated, there is considerable non-productive time involved in a conventional plug mill sequence, while the mill rolls are opened up and the shell is returned back to the upstream side of the mill. Even through the shell is returned at relatively high speeds, the time loss is significant to the point that, in a conventional mill operation, the plug mill may constitute a bottleneck in the overall production sequence.

In accordance with the present invention, an improved plug mill system and method of operation is provided which avoids the need for stripping of the tubular shell off a mandrel, as an independent operation after each pass through the plug mill. Rather, in accordance with the invention, a system of circulating mandrels is provided, in conjunction with a pair of sequentially related mill stands. The arrangement is such that the operation of stripping the tubular shell off a mandrel is accomplished in conjunction with a working pass of the tubular shell through a mill stand, rather than as an independent operation. This enables the shell to receive the necessary two passes through the plug mill stands in substantially less time than in a conventional mill, to the extent that the plug mill operation is no longer a bottleneck in the production sequence.

While the method and apparatus of the present invention involves the use of two sequentially related mill stands, whereas only a single mill stand is used in a conventional mill, the increase in capital costs is relatively limited and very favorable in terms of the increase in performance achieved. In this respect, the mill stands can be much simpler in design than conventional mills, inasmuch as no provision is necessary for quick opening of the rolls. Likewise, it is not necessary to provide stripping rolls, and the related drive systems therefore, for returning the shell to the upstream side of the mill stands. In addition, although a circulating supply of mandrels is provided in the system of the invention, it is not necessary to provide the somewhat more complex plug changing systems typically required in conventional systems, in an effort to minimize cycle time. Moreover, in some embodiments of the new system, it is possible to utilize the mandrels in tension, rather than in compression as is customary in conventional plug mills, enabling smaller mandrels to be utilized.

For a better understanding of the above and other features and advantages of the invention, reference should be made to the following detailed description of preferred embodiments of the invention, and to the accompanying drawings.

DESCRIPTION OF PREFERRED EMBODIMENTS OF THE INVENTION

Figure 1:
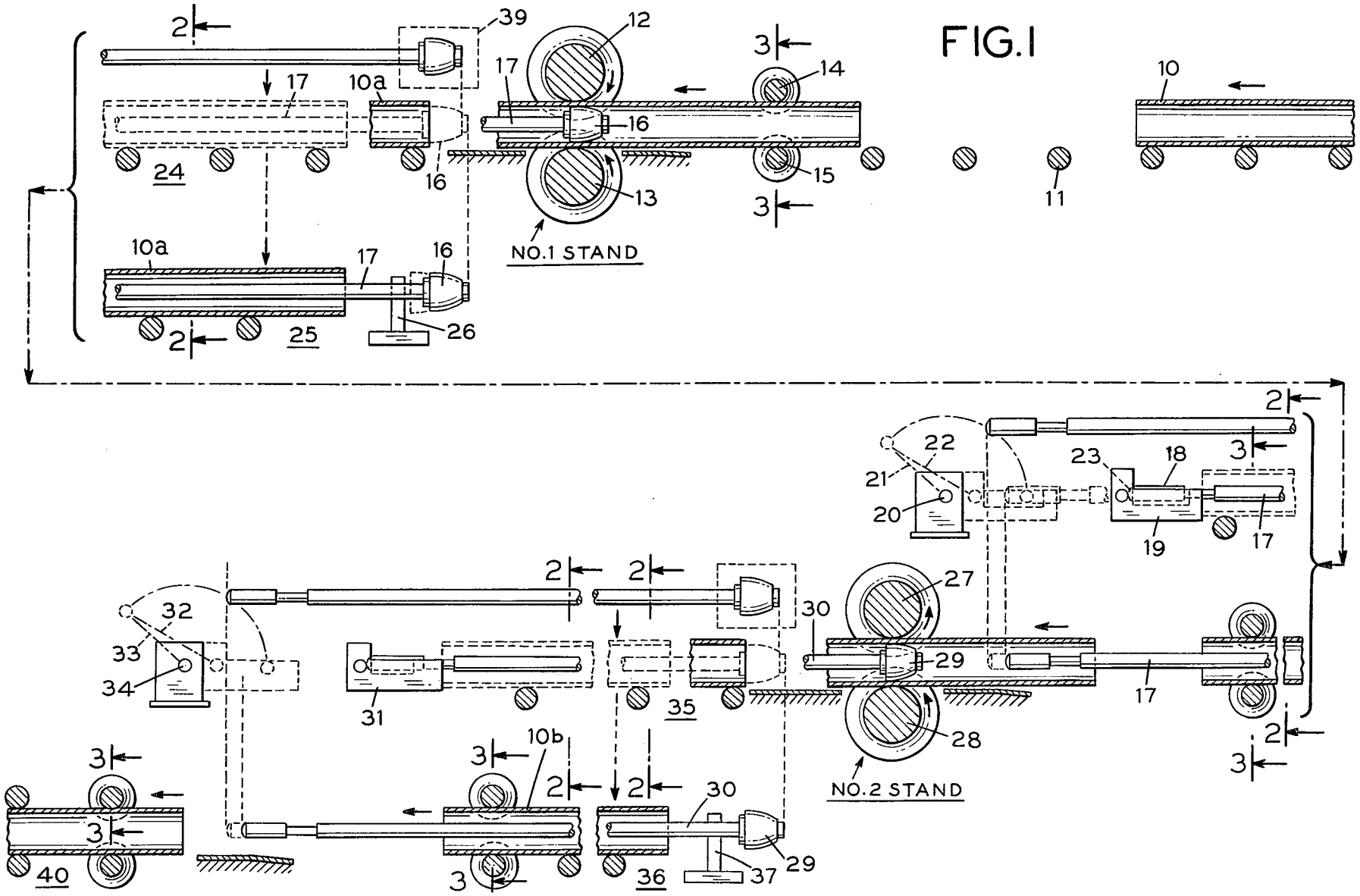
FIG. 1 is a simplified schematic flow sheet type representation of a two stage plug mill incorporating the principles of the invention, illustrating a form of the invention in which the mandrel is used in a compression mode.
Figure 3:
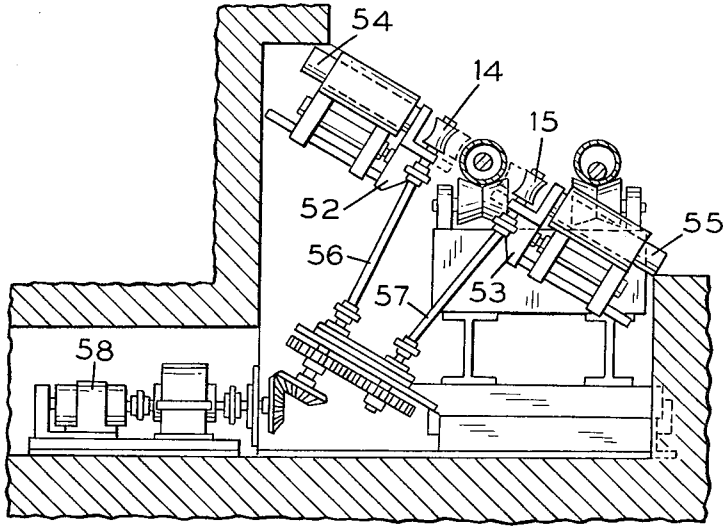
FIGS. 2 and 3 are cross sectional views of loading and feeding mechanisms respectively, as is taken on lines 2—2, 3—3 respectively of any of FIGS. 1, 4 and 5.
Figure 2:
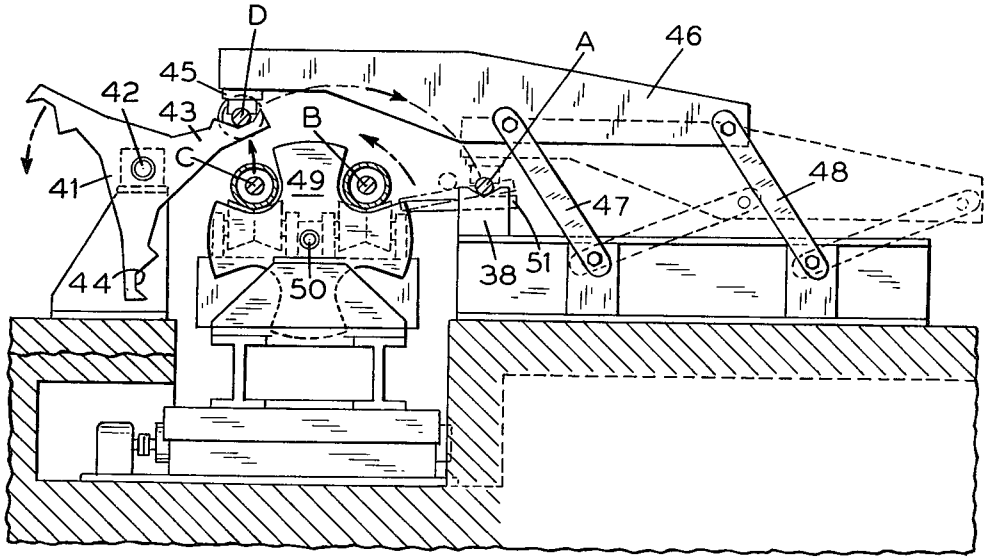

Referring now to the drawings, and initially to FIGS. 1-3, the reference numeral 10 designates an incoming tubular shell, from a prior piercing operation, being advanced along feed table rolls 11 toward the working rolls 12, 13 of a first plug mill stand. Upstream of the stand, there is a movable set of feed rolls 14, 15 (see FIG. 3) arranged to engage and drive the oncoming tubular shell into the bite of the mill stand. Once in the bite of the mill, the tubular shell is driven on through by the action of the mill rolls.

In the first illustrated form of the invention, a mandrel plug 16 is mounted on the end of a mandrel 17 extending downstream from the number one mill stand. The mandrel is arranged to be supported at its downstream end, so as to be in a compression mode when supporting the mandrel plug 16. As shown in the lower portion of FIG. 1, the mandrel 17 has an end portion 18, which is arranged to be received in and gripped by a movable mandrel anchor 19. The mandrel anchor 19 is suitably supported for horizontal motion, and is driven by a rotary drive mechanism 20, which operates a crank arm 21, driving a connecting link 22.

At the commencement of a rolling sequence in the number one mill stand, the rotary mechanism 20 is operated to rotate the crank arm 21 clockwise from the position shown in FIG. 1, until the crank arm 21 and connecting link 22 are substantially aligned in a horizontal plane. The mandrel anchor 19, at this point, is in the position shown in full lines in FIG. 1, with the anchor end 18 of the mandrel being seated firmly in a suitable pocket 23 formed in the mandrel anchor 19. When the anchor is thus positioned, the mandrel plug 16 is positioned directly in the bite of the mill rolls 12, 13, as shown in full lines in the upper portion of FIG. 1. The tubular shell 10 can then be advanced into the roll bite and driven through by the mill rolls 12, 13, being worked in the usual manner between the mill rolls and the mandrel plug.

In accordance with the invention, after the tubular shell 10 has passed through the number one mill stand, and has cleared the exit side of the mill rolls, the rotary drive 20 is actuated to move the crank arm 21 counterclockwise, retracting the mandrel anchor 19 to the position shown in phantom lines in the lower portion of FIG. 1. This draws the mandrel bar 17 and plug 16 clear of the mill stand, as reflected in broken lines in FIG. 1.

Whereas conventional practice provides that the mill rolls 12, 13 be opened up after completion of a rolling operation, and the processed tubular shell **10*a* be stripped off the mandrel 17 and returned to the entry side of the mill stand, the procedure of the present invention provides for the mandrel 17 to remain with the processed shell 10*a* while the shell is transferred laterally onto a new axis, aligned with a second mill stand, identified in FIG. 1** as the number two stand.

As reflected in FIG. 1, after the processed tubular shell **10*a* has passed through the number one stand, its trailing end is downstream of the mandrel plug 16. Thereafter, the entire combination of the processed shell 10*a* and the plug-mandrel assembly 16–17 is shifted laterally from the outlet table 24 for the number one stand, to the feed table 25 for the number two stand. Typically, this may represent a short lateral transfer, capable of being accomplished with a simple star wheel transfer mechanism, generally as shown in FIG. 2** and to be described in more detail hereinafter.

Adjacent the upstream end of the feed table 25 for the number two stand is a retaining bracket 26. This bracket is engageable with the mandrel 17 on the downstream side of the plug 16, which is secured to the mandrel. Thus, when the tubular shell **10*a* is advanced along the feed table 25, into and through the number two stand, it is simultaneously stripped off of the first stage mandrel 17**. Uniquely, the stripping of the first stage mandrel occurs during the feeding and second stage rolling of the tubular shell, entirely eliminating the conventional independent step of stripping the shell from the mandrel during a non-producing phase of the plug mill cycle.

As reflected in FIG. 1, the number two mill stand functions substantially the same as the number one stand. The mill is a typical two-high mill, with primary mill rolls 27, 28 arranged for cooperation with a plug 29 supported by a mandrel 30 used in the compression mode. The mandrel 30 is engaged at its end by an anchor member 31 movable horizontally between working and retracted positions by means of a connecting link and crank arm assembly 32, 33 operated by a rotary drive 34. As in the case of the operation of the number one stand, after passage of the tubular shell through the second stage mill, the processed shell, now identified by the reference numeral **10*b*, is transferred laterally from the run-out table 35 for the number two mill to an off-loading conveyor 36. The mandrel 30 and the plug 29 are held by a plug-engaging support bracket 37 on the outlet conveyor 40, so that the shell 10*b*** is automatically stripped from the mandrel as the shell is conveyed away from the second stage of the mill.

Desirably, a series of three mandrel-plug assemblies is provided for use in conjunction with each of the mill stands. These three mandrel-plug assemblies are used in a rotational sequence. While one of the mandrel-plug assemblies is in use in the mill, a second one is in the next stage of processing (aligned with either the next mill or the off-loading conveyor) while the third is being cooled and readied for the rolling of the next shell. The manipulation of the various mandrels advantageously is accomplished generally in the manner shown in FIG. 2. A mandrel A in the ready position is supported by a rack 38 alongside the axis of the mill. At one end of the rack 38 there is a cooling facility 39 (see upper portion of FIG. 1), by which cooling water may be sprayed on to the hot mandrel plug 16 while it is in its stand by condition. At any given time during operation of the mill, a second mandrel B is aligned with the working axis of the mill and is properly positioned to accommodate actual rolling of a tubular shell. The third mandrel C is aligned with the axis of the number stand, or the outlet conveyor, as the case may be.

Figure 4:
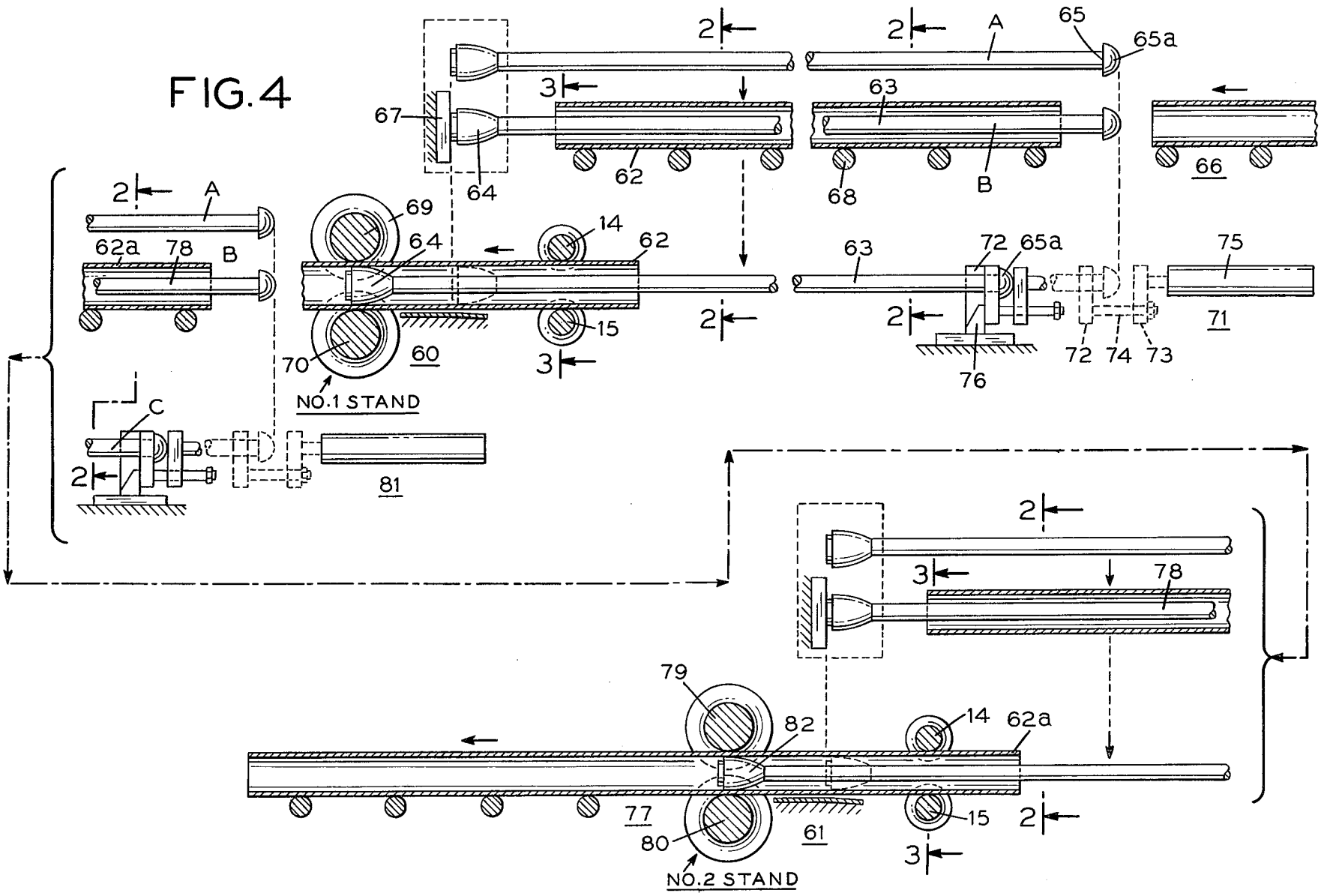
FIG. 4 is a simplified flow sheet type representation of a modified form of two stage plug mill according to the invention, in which the mandrel is utilized in a tension mode.
Figure 5:
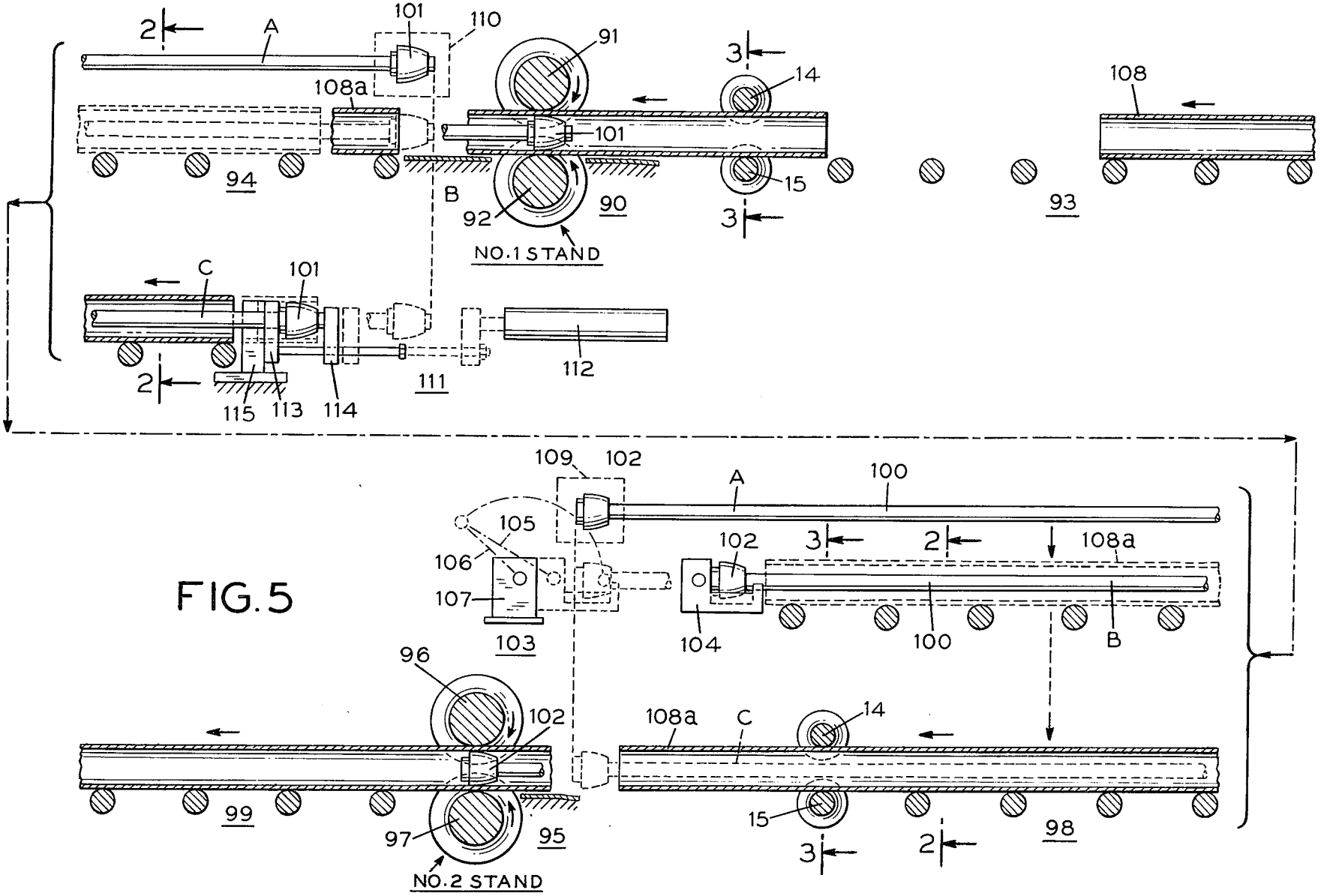
FIG. 5 is a simplified flow sheet representation of a two stage plug mill according to the invention, in which there is a double-ended mandrel utilized in both the compression and tension modes in successive stages of mill operation.

As will be evident from the description herein, the shell and mandrel handling facilities of FIG. 2 are utilized in a plurality of locations, not only in the system of FIG. 1, but also in the systems of FIGS. 4 and 5. Typically, there will be two such facilities for each set of mandrels, located generally as indicated by the section lines 2—2 in each of FIGS. 1, 4 and 5. During a tube rolling operation, while a tubular shell is being drawn over the mandrel in the position B, the tubular shell initially surrounding the mandrel in the position C is also being withdrawn from that mandrel. Where the mandrel at B is the working mandrel for the number one stand, the mandrel at C is being stripped by movement of the tube into the number two stand. Likewise, if the mandrel in the position B is the working mandrel for the number two stand, then the tube surrounding the mandrel at the position C is being stripped off by the outlet conveyor. In either instance, at the completion of the operation, the mandrel at C has been stripped and is ready to be moved back to position A.

To remove the stripped mandrel C, each mandrel manipulating installation includes two or more sets of lifting wheels 41 rotatably mounted on shafts 42. In the illustrated arrangement, the lifting wheels include three sets of lifting arms 43, each having a mandrel receiving pocket 44. At the appropriate time, the lifting wheels 41 are indexed through one-third of the revolution in a counterclockwise direction (as viewed in FIG. 2). This brings an empty arm 43 upward underneath the mandrel, lifting it off of its supporting rolls and raising it to a position indicated at D in FIG. 2. The mandrel is the position D is picked up by pairs of electromagnetic elements 45 mounted on transfer arms 46 supported by pairs of parallel links 47, 48. Desirably, the transfer arms 46 will be in their extended and raised positions (shown in full lines in FIG. 2) in advance of indexing of the lifting wheel 41, so that a mandrel can be lifted from the position C directly into contact with the magnetic gripping elements 45.

After the mandrel has been lifted from the position C to the position D, the mandrel at the position B, which is now surrounded by a processed tubular shell from the just completed rolling operation, is transferred from the position B to the position C. To advantage, this is accomplished by means of pairs of four-position transfer wheels 49, supported for rotation by shafts 50. By rotating the wheels 49 through an angle of 90°, a mandrel and shell in the position B are transferred over to the position C; simultaneously, the tubular shell is reoriented by 90°, as is desired between rolling operations at the number one and number two stands.

After indexing of the wheel 49, a bare mandrel at position A is advanced to position B. This may be accomplished by any suitable means, such as kickout bars 51, which can be lifted to raise the mandrel above its support 38, permitting the mandrel to roll by gravity down an incline to the position B. The kickout bars 51 are then returned to their normal positions, and the cantilevered transfer arms 46 can now be actuated to bring a just-used mandrel from the position D and deposit it on the rack 38, in position A.

As will be appreciated, if additional cooling time is required, it is possible to circulate more than three mandrels. In that case, there will be a plurality of mandrels at the waiting position A undergoing cooling, but the sequence of operations is otherwise substantially the same.

As in the case of the transfer mechanisms of FIG. 2, a feed roll mechanism of the type indicated in FIG. 3 may be utilized in any of the systems of FIGS. 1, 4 and 5, in any of the locations indicated by the cross sectional lines 3—3. Typically, the feed roll units will include slide members 52, 53 for the respective feed rollers 14, 15, each being movably positioned by means of a hydraulic actuator 54, 55. The feed rolls are driven through universal drive shafts 56, 57 from a common drive motor 58. The arrangement is such that the feed rolls can be widely separated to accommodate lateral transfer of the tubular shells, and also to permit the shells to be driven by the mill rolls, for example. When it is desired to bring the feed rolls into engagement with a tubular shell, the actuators 54, 55 are appropriately energized closing the feed rolls down on to the shell, into gripping and feeding engagement.

In the system of FIG. 1, the function of each of the rolling stages is substantially conventional during the actual rolling operations. However, significant economies are realized in the overall processing sequence by avoiding the usual stripping and return operation, which involves separation of the primary mill rolls, gripping of the shell by stripping rolls, and returning the shell to the upstream side of the mill stands. Instead, in the system of FIG. 1, the mandrel-plug combination is retracted from the mill stand, and the just-processed shell, still containing the mandrel, is bodily transferred laterally onto the working axis of the number two stand, while a new mandrel is being brought into position in the number one stand. Upon completion of these lateral transfers, rolling operations can proceed in both the number one and the number two stands.

In another form of the invention, illustrated in FIG. 4, arrangements are made for utilizing the mandrels in a tension mode. The procedure of FIG. 4 enables the significant advantages of the FIG. 1 process to be realized, but enjoys additional advantages. In this respect, the mandrels required for the processing operations in the FIG. 4 system may be both smaller in diameter and shorter in length than the mandrels used in the FIG. 1 process. Thus, by using the mandrels in tension, it is not necessary to provide for column strength to support a compression load, nor is it necessary to provide lateral support for the mandrels against buckling under compression. Moreover, when using the mandrels in a tension mode, they are anchored upstream of the mill stands, and the length thereof is related to the length of the shell prior to elongation. As a result, the mandrels used in tension may be considerably shorter in length than those used in compression.

With specific reference to FIG. 4, number one and number two mill stands 60, 61 respectively are sequentially related for successively acting on a tubular shell 62. On the upstream side of each of the mill stands there is provided a set of circulating mandrels 63, with generally three mandrels in each set. A mandrel plug 64 is fixed to the downstream end of each of the mandrels 63, and means 65 are provided at the upstream end of the mandrels to form a positioning shoulder. Typically, the shoulder is formed by providing an enlargement **65*a*** at the upstream end of the mandrel.

Considering first the mandrel set associated with the number one stand, the mandrel at position A is idle and cooling. The mandrel in position B is aligned with an inlet conveyor table 66, and is thus in a load position, arranged to have received over it a tubular shell 62 ready to be rolled. Adjacent the downstream end of the mandrel in the load position B, there is an abutment plate 67, which serves as a stop against which the mandrel end can be seated. This enables an incoming tubular shell 62, on the inlet conveyor, to be driven by conveyor rolls 68 on to the mandrel, in readiness for transfer to the rolling position.

After being loaded with a shell, the mandrel is transferred from position B into the working position C, aligned with the working rolls 69, 70 of the number one stand. Lateral transfer of the mandrels is, of course, handled by mechanisms of the type shown in FIG. 2, located for example at places corresponding generally to the section lines 2—2 in FIG. 4.

When the loaded mandrel is transferred from position B to position C in FIG. 4, the positioning shoulder forming an enlargement **65*a* is received in a positioner, generally designated by the numeral 71. The positioner includes forward and rearward jaws 72, 73, connected by guide rods 74. The forward jaw 72 is appropriately notched to receive the shank portion of the mandrel 63, while providing a seat to engage the shoulder 65. When the positioner 71 is retracted, the jaws 72, 73 are open to receive the shouldered end 65*a* of the mandrel. Thereafter, the positioner is advanced, by actuation of a fluid cylinder 75, until the forward jaw 72 engages a rigid fixed abutment structure 76. Further advancement of the positioner causes the rearward jaw member 73 to close upon the enlarged head 65*a*, as shown in full lines in FIG. 4, so that the head end of the mandrel 63 is firmly held in position, with the tension load on the mandrel being supported by the abutment 76 and the forward clamping jaw 72**.

When the mandrel is properly clamped and located by the positioner 71, the plug 64 is positioned in the bite of the mill rolls 69, 70. The feed rolls 14, 15 can then be closed on the tubular shell 62, and the shell advanced into the bite of the mill rolls. During the actual rolling operation, the mandrel 63 is in tension while it supports the plug 64 in the roll bite. Maintaining the mandrel in the tension mode has significant advantages over the compression mode, as explained above. In addition, it will be further noted that, as the tubular shell 62 is being driven through the number one stand, it is simultaneously being stripped from the mandrel 63. Accordingly, as soon as the rolling operation is complete at the number one stand, the mandrel is already stripped and can be returned, via mechanisms of the type shown in FIG. 2, to the ready position at A, after retraction of the positioner 71.

In the system illustrated in FIG. 4, a series of circulating mandrels is provided at the ready position A, loading position B and working position C, on the upstream side of the number two mill stand 77. In accordance with the invention, the loading position B for the second stage mandrels 78 is aligned with the axis of the number one mill stand and is positioned immediately downstream thereof. Accordingly, as the tubular shell 62 emerges from the discharge side of the number one stand, the shell is automatically fed onto the second stage mandrel 78 in the load position B. As soon as the first stage rolling operation is completed, the second stage mandrel and the just loaded shell 62*a* are transferred laterally, by means of FIG. 2 mechanisms, into the working position C, aligned with the primary rolls 79, 80 of the number two stand. A second stage positioner 81, generally similar to the first stage positioner 71, moves the mandrel 78 in a downstream direction, bringing its plug 82 into proper position in the bite of the mill rolls. At this point, the second stage feed rolls 14, 15 can be moved into gripping position to drive the shell 62*a* into engagement with the second stage mill rolls.

As in the case of the number one stand, as the tubular shell 62*a* passes through the number two mill stand, it is automatically stripped from the second stage mandrel 78 so that, as the rolling operation concludes, the mandrel is immediately available to be removed and replaced by a loaded mandrel from a just-completed first stage rolling operation. Likewise, the second stage mandrels are operated in a tension mode, as are the first stage mandrels, although the second stage mandrels will have to be somewhat greater in length, to accommodate for the lengthening of the tubular shell during the first stage of rolling.

The system illustrated in FIG. 4, retains the significant time cycle advantages of the system of FIG. 1 and, in addition, enables the practical utilization of mandrels in a tension mode. The mandrels can thus be of smaller diameter and of shorter length than more conventional, compression mandrels. The use of the mandrels in a tension mode also eliminates the need for providing special anti-buckling supports, which are sometimes required in connection with mandrels used in the compression mode.

In the system illustrated in FIG. 5, further advantages are realized through the utilization of double-ended mandrels, that is, mandrels with a plug at each end, so that first and second stage rolling operations may proceed in sequence without utilizing a new mandrel. With such arrangement, the mandrel is used in the compression mode during the first stage of rolling and in the tension mode during the second stage of rolling. A single set of circulating mandrels is all that is required for operation under this modification of the invention.

With particular reference to FIG. 5, the number one mill stand 90 is comprised of upper and lower rolls 91, 92 aligned with an inlet conveyor 93 and feed rolls 14, 15, the latter being of the type shown in FIG. 3. An outlet conveyor 94 is provided on the discharge side of the number one mill stand to receive the discharged workpiece. A number two mill stand 95, comprising mill rolls 96, 97 is positioned downstream of the number one mill stand and is offset laterally therefrom. Inlet and outlet conveyors 98, 99 are associated with the number two mill stand as indicated.

A circulating series of mandrels 100 is provided, typically at least three, arranged to be circulated by means of mechanisms such as shown in FIG. 2. At the upstream end of the mandrel there is secured a first stage mandrel plug 101, and a second stage mandrel plug 102 is secured at the downstream end of the mandrel.

For the first stage rolling, a mandrel, in the working position B, is positioned with its first stage plug 101 in the bite of the number one mill stand by means of a positioner 103, including an anchor element 104, link 105, rotary crank 106 and rotary drive 107. The positioner 103 is similar to that used in connection with the system of FIG. 1, with the anchor member 104 having an appropriate recess for the reception of the second stage mandrel plug 102. With the mandrel plug 101 properly positioned in the number one stand, a tubular shell 108 can be advanced along the inlet conveyor, gripped by the feed rollers 14, 15 and advanced into the bite of the number one mill stand. The rolling operation then proceeds in the usual manner.

After completion of the first stage of rolling, the processed tubular shell 108*a* surrounds the mandrel 100, being straddled by the respective mandrel plugs 101, 102. In this respect, the length of the mandrel bar 100 is calculated to be somewhat greater than the intermediate length of the shell 108*a* after the first stage of rolling.

Upon completion of the first rolling stage, the positioner 103 is actuated to retract the mandrel back to its "normal" position in the circulating mandrel group. The just-used mandrel, in position B, can then be laterally transferred, along with the once-processed shell 108*a* over into a second working position C, in alignment with the number two mill stand. The circulation of the other mandrels proceeds, in general, in the manner previously described with reference to the other systems. A previously used mandrel at the position C is lifted up to the position B (see FIG. 2) and transferred back to position A, while a mandrel at position A is moved into the first stage working position B. Cooling facilities 109, 110, such as water sprays, are provided at the ready position A, for cooling of the just-used mandrel plugs 101, 102.

After transfer of a mandrel and a once-rolled shell 108*a* from the B position to the C position, the mandrel 100 in position C is engaged by a positioner 111, including a fluid actuator 112, front and back relatively movable positioner jaws 113, 114 and a rigid abutment stop 115. With the actuator 112 retracted, the jaws 113, 114 are opened to receive the plug end 101 of the transferred mandrel. The positioner actuator 112 is then extended, first closing the jaws 113, 114 on the mandrel head and then advancing the mandrel until the forward jaw is seated rigidly against the abutment stop 115. The mandrel in position C is now rigidly supported for use in the tension mode, with its downstream or second stage mandrel plug 102 properly positioned in the bite of the mill rolls 96, 97 of the number two mill stand 95. At this time, the once-rolled tubular shell 108*a* is gripped by closure of the feed rolls 14, 15 and is advanced into the bite of the number two mill stand for a second stage of rolling over the mandrel plug 102. In this respect, it will be understood that the tubular shell 108*a* will have been rotated 90° during transfer from position B to position C.

At the completion of the second stage of rolling, the mandrel 100 in the position C is retracted, by retraction of the positioner cylinder 112, bringing the mandrel back to its normal position for transfer in the circulating mandrel supply. It will be understood, of course, that in a continuous production operation, rolling will be proceeding more or less simultaneously in the number one stand and the number two stand, with one shell being rolled in the number two stand and the next subsequent shell being processed in the number one stand. As soon as both rolling operations are complete, the circulating mandrels may be transferred.

In the system of FIG. 5, the time cycle advantages of the systems of FIGS. 1 and 4 are realized, with the additional advantage that only a single set of circulating mandrels may be provided since each mandrel has both first stage and second stage mandrel plugs secured thereto at opposite ends.

In any of the various forms of the invention, a seamless tubular shell is passed through two successive plug mill stands, rather than twice through the same plug mill stand as is more conventional. In conjunction with the use of successive mill stands, provision is made for the tubular shell to be transferred from one rolling stage to the next without a separate, intermediate operation of stripping that once rolled shell from a mandrel. Thus, in cases where a mandrel is used in a compression mode and the tubular shell surrounds the mandrel after rolling, the mandrel and shell are simply transferred together over onto the inlet table for the number two stand. The second stage of rolling then proceeds, and the shell is stripped off of the first stage mandrel during the second stage rolling operation.

Where the mandrels are used exclusively in the tension mode, stripping of the shell off of the mandrel occurs simultaneously with the rolling operation. Loading of the shell onto the mandrel occurs, in the first stage, as the shell approaches the number one stand. For a second stage, loading of the shell onto the tension mode mandrel occurs automatically as the shell is discharged from the exit side of the number one stand.

In the case of the embodiment of FIG. 5, when the same mandrel is used in both compression and tension modes, the shell is loaded onto the mandrel during the first stage of rolling, and is stripped off of the mandrel during the second stage.

In any of its various forms, the procedure and apparatus of the invention enable the plug mill operations to be carried out at an overall average rate of speed greater than is customary for the piercing operations, rather than vice versa. Accordingly, whereas the plug mill operations conventionally represent a bottleneck in the production of seamless tubes, with the new processing sequence, the plug mill can easily equal or exceed the pace of other stages of processing.

Although the invention involves the use of two separate mill stands, rather than the conventional single mill stand, the compensating factors provide a favorable balance. For example, the mill stands are substantially simpler in construction, since provision for quick opening of the rolls is unnecessary. Likewise, means for engaging and returning the shell at high speed back to the entry side of the mill stand are not required in the new system. Overall, any increase in the overall capital cost of the equipment for the new process is more than compensated for by the increase in production over the entire seamless tube production line, which is enabled by eliminating a bottleneck at the plug mill.

It should be noted that in each case the invention provides for rotating the tube approximately 90° between the number one pass and the number two pass but that the same function can be achieved by transferring the tube without rotation and orienting the work rolls in the number two mill 90° from the orientation of number one mill.

Also, it is considered that the optimum time cycle is obtained by offsetting number one mill with respect to number two mill but appropriate mechanisms can be devised whereby the basic principle of the invention is embodied in a system where number one mill and number two mill are in line with rolls oriented 90° from one another.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. The method of carrying out plug mill operations on a seamless tubular shell, which comprises a. advancing the shell into and through a first rolling stage, in which the shell is driven through a first mill stand and over a first mandrel supported plug, b. after completion of the first rolling stage and while the tubular shell remains on the discharge side of the first mill stand, transferring the shell laterally into alignment with a second mill stand spaced longitudinally downstream of the first mill stand, c. thereafter advancing the tubular shell through a second rolling stage in which said shell is driven through said second mill stand and over a second mandrel supported plug, and d. simultaneously with the advancement of a tubular shell in conjunction with at least one of said rolling stages stripping the tubular shell off of a plug-supporting mandrel.

2. The method of claim 1, further characterized by a. said tubular shell being engaged in the bits of a mill stand during stripping of said shell from the mandrel.

3. The method of claim 1, further characterized by a. the mandrels for said plug mill operations being operated in a tension mode, b. during each rolling stage the tubular shell is being stripped from the mandrel for that stage, and c. simultaneously with said first rolling stage, said tubular shell is being loaded onto a mandrel for the second rolling stage.

4. The method of claim 1, further characterized by a. the mandrels for said plug mill operations being operated in a compression mode, and during the second stage of rolling, the tubular shell is being stripped off of the mandrel for the first rolling stage.

5. The method of claim 1, further characterized by a. a single mandrel being utilized in both the first and second stages of rolling, b. said mandrel being used in a compression mode during the first stage and in a tension mode during the second stage, and c. said tubular shell being stripped off of said mandrel during said second stage of rolling.

6. The method of claim 1, further characterized by
a. a mandrel for the second stage of rolling being positioned within the tubular shell during lateral transfer thereof into alignment with the second mill stand.

7. The method of claim 6, further characterized by
a. said method including the circulation of at least three mandrels for a rolling stage,
b. one of said mandrels being in use during rolling, another being stripped, and one or more being cooled.

8. The method of claim 7, further characterized by
a. said mandrels being used exclusively in a tension mode or compression mode, and
b. there being a set of at least three mandrels in use for each rolling stage.

9. The method of claim 7, further characterized by
a. there being a single circulating set of mandrels for both stages, each with a plug at both ends,
b. the same mandrel being used for the rolling of a tubular shell in both stages,
c. said mandrels being used in a compression mode in the first stage and in a tension mode during the second stage.

10. The method of carrying out plug mill operations on a seamless tubular shell, which comprises
a. advancing the shell through a first rolling stage in which the shell is driven through a first mill stand and over a first mandrel supported plug,
b. during said first rolling stage, advancing the shell over a mandrel bar,
c. upon termination of the first rolling stage, transferring the shell and the mandrel bar contained within it laterally,
d. thereafter advancing the shell through a second rolling stage, in which the shell is driven through a second mill stand and over a second mandrel supported plug, and
e. stripping the shell from said mandrel bar during the second rolling stage.

11.. The method of claim 10, further characterized by
a. said mandrel bar supports said second plug during said second stage rolling.

12. The method of claim 10, further characterized by
a. said mandrel bar supports said first and second plugs respectively at its upstream and downstream ends during said first and second stages of rolling.

13. The method of claim 10, further characterized by
a. controllably positioning said mandrel bar longitudinally, to position a plug supported thereby in a roll bite for a rolling stage and to position said plug in a retracted position for lateral transfer.

14. A plug mill system for rolling seamless tubular shells, which comprises
a. first and second mill stands,
b. said second mill stand being spaced longitudinally from said first mill stand a distance greater than the length of a tubular shell after rolling in the first mill stand,
c. said second mill stand being offset laterally from said first mill stand,
d. a mandrel,
e. means for supporting said mandrel in alignment with said first mill stand and on the downstream side thereof during rolling of a tubular shell in said first mill stand whereby, as said rolling progresses, the rolled shell is applied over said mandrel,
f. means for laterally transferring the once-rolled shell and said mandrel laterally into alignment with said second mill stand, and
g. means for supporting said mandrel during rolling of said shell in said second mill stand, whereby said shell is stripped from said mandrel as rolling progresses in said second mill stand.

15. A plug mill according to clain 14, further characterized by
a. said mandrel mounting a first stage mandrel plug at its upstream end for cooperation with rolls of said first mill stand.

16. A plug mill according to claim 14, further characterized by
a. said mandrel mounting a second stage mandrel plug at its downstream end for cooperation with rolls of said second mill stand.

17. A plug mill according to claim 14, further characterized by
a. said mandrel mounting mandrel plugs at both ends for selective and sequential cooperation with rolls of the respective first and second mill stands.

18. A plug mill according to claim 14, further characterized by
a. said system including a plurality of circulating mandrels useable in sequence,
b. means for laterally transferring a cooled mandrel into alignment with the first stage mill stand when said first mentioned mandrel is transferred laterally into alignment with said second mill stand, and
c. means for laterally transferring a stripped mandrel from a position in alignment with the second mill stand to a cooling position.

19. A plug mill according to claim 14, further characterized by
a. mandrel position means being provided for engaging the remote end of a mandrel during use thereof in a rolling operation,
b. said position comprising a mandrel engaging means and a positioner actuator, and
c. means substantially independent of the positioner actuator for rigidly supporting said mandrel engaging means during a rolling operation.

* * * * *